US008683980B2

(12) United States Patent
Falkowski et al.

(10) Patent No.: US 8,683,980 B2
(45) Date of Patent: Apr. 1, 2014

(54) GENSET ENGINE WITH AN ELECTRONIC FUEL INJECTION SYSTEM INTEGRATING ELECTRICAL SENSING AND CRANK POSITION SENSING

(75) Inventors: David T. Falkowski, Blaine, MN (US); Jeffrey D. Peterson, St. Paul, MN (US); Matthew J. Ethen, New Brighton, MN (US); Kristopher G. Knight, St. Louis Park, MN (US); Peter J. Vancalligan, Blaine, MN (US)

(73) Assignee: Cummins Power Generation, Inc., Minneapolis, MN (US)

( * ) Notice: Subject to any disclaimer, the term of this patent is extended or adjusted under 35 U.S.C. 154(b) by 1100 days.

(21) Appl. No.: 12/695,493

(22) Filed: Jan. 28, 2010

(65) Prior Publication Data

US 2011/0180043 A1 Jul. 28, 2011

(51) Int. Cl.
*F02M 51/00* (2006.01)

(52) U.S. Cl.
USPC ..... 123/478

(58) Field of Classification Search
USPC ..... 123/478, 434, 472, 690; 290/1 A, 1 B, 290/40 B, 40 C, 40 F; 701/103
See application file for complete search history.

(56) References Cited

U.S. PATENT DOCUMENTS

| | | | | |
|---|---|---|---|---|
| 6,443,126 | B1 * | 9/2002 | Morimoto et al. | 123/339.15 |
| 7,524,266 | B2 * | 4/2009 | Nobumoto et al. | 477/110 |
| 8,115,328 | B2 * | 2/2012 | Fosbinder et al. | 290/40 C |
| 2004/0021320 | A1 * | 2/2004 | Yamada et al. | 290/1 B |
| 2007/0158945 | A1 * | 7/2007 | Annen et al. | 290/1 A |
| 2009/0063008 | A1 * | 3/2009 | Ishikawa et al. | 701/102 |
| 2010/0063707 | A1 * | 3/2010 | Luo | 701/102 |
| 2012/0126543 | A1 * | 5/2012 | Simpson et al. | 290/1 A |

* cited by examiner

*Primary Examiner* — Stephen K Cronin
*Assistant Examiner* — Sizo Vilakazi
(74) *Attorney, Agent, or Firm* — Foley & Lardner LLP

(57) ABSTRACT

An open or closed loop EFI system, integrated on a genset engine or any internal combustion engine, with an electrical sensor and crank position sensor is described. Since a genset engine's exhaust emissions and general performance are a function of spark timing, integration of electrical and crank position sensors on a genset engine provides optimal engine performance and efficiency when the electrical draws fluctuate. The electrical sensor and crank position sensor send data to the electronic control unit (ECU), and this data is used to determine the optimal air-to-fuel ratio (AFR) and optimal spark timing. The ECU varies the spark timing in accordance with the speed and load of the engine and actuates the fuel injector to send the correct amount of atomized fuel to mix with the air flow to be combusted allowing the engine to meet performance.

14 Claims, 6 Drawing Sheets

GENSET ENGINE WITH AN ELECTRONIC FUEL INJECTION SYSTEM INTEGRATING ELECTRICAL SENSING AND CRANK POSITION SENSING

FIELD

This disclosure relates using open loop and, alternately, closed loop electronic fuel injection (EFI) systems with electrical sensing and crank position sensing on internal combustion engines, particularly in genset engines as one example. Various engine sensors, including for example air sensors, send signals to an electronic control unit (ECU) which in turn controls the fuel/air mixture to reach the requested relative air-to-fuel ratio (AFR) resulting in improved and efficient engine performance. The electrical sensor determines the amount of power being output by the alternator and the amount of power being drawn by the system to further calibrate the AFR. The crank position sensor determines the location of the piston in order to facilitate optimal spark timing. This information is provided to the ECU to control the AFR and control the spark timing to maintain optimal engine performance and efficiency.

BACKGROUND

Fuel injection systems are known and mix fuel with air in internal combustion engines. Fuel is forcibly pumped through a fuel injector resulting in atomization of the fuel which is then mixed with air and is either indirectly or directly placed in the combustion chamber. The air-to-fuel ratio must be precisely controlled to achieve desired engine performance, emissions, and fuel economy. Electronic fuel injection systems control the amount of fuel injected by reacting to continuously changing inputs provided by various sensors, where each sensor's information is sent to an electronic control unit (ECU).

A known open loop electronic fuel injection (EFI) system is illustrated in FIG. 1. The known open loop EFI system 10 includes for example a fuel injector 12, an electronic control unit (ECU) 14, an air flow sensor (e.g. manifold absolute pressure MAP) sensor 16, communication circuitry 18 linking the ECU 14 and the MAP sensor 16 and communication circuitry 20 linking the ECU 14 and the fuel injector 12. Other components, that are known in the industry but not shown, include a fuel pump, a fuel pressure regulator, other various input sensors, which may include but are not limited to, a hall effect sensor, a throttle position sensor, a coolant temperature sensor, an oil temperature sensor, and other air flow sensors such as a manifold air temperature (MAT) sensor.

A known closed loop EFI system is illustrated in FIG. 2. The components of the closed loop EFI system 40 are generally the same as that of the open loop EFI system 10 except for the addition of an oxygen sensor 42 located in the exhaust system 22. Communication circuitry 44 links the ECU 14 and the oxygen sensor 42.

Common features known to both the open and closed loop EFI engine systems 10, 40 of FIGS. 1 and 2 include an exhaust system 22, an intake system 24, the engine 26, an alternator 28, and a gas tank 30. Air flow 32 enters at the intake system 24 and exhaust flow 34 exits at the exhaust system 22. Fuel 36 moves from the gas tank 30 to the fuel injector and is atomized. The atomized fuel 38 enters the intake system.

With further reference to the open loop EFI system 10, a MAP sensor 16 senses the amount of vacuum in the intake manifold and transmits this data to the ECU 14. The ECU 14 uses this information to determine the requested relative air-to-fuel ratio (AFR), which is a value set in the software, which will provide suitable engine performance. The ECU 14 electrically actuates the fuel injector 12 so that the atomized fuel 38 mixes with the air flow 32 to reach the requested relative AFR. Open loop EFI systems 10 do not receive any feedback as to whether the correct AFR is being achieved. Thus, the AFR may be incorrect due to any of the degradation of the fuel injector 12, the MAP sensors 16 becoming out of tolerance, etc. While an open loop EFI 10 is a lower cost system, the engine may not meet performance and emission requirements since there is not sufficient air/fuel mixture control to enable effective exhaust catalysis.

With further reference to the closed loop EFI system 40 of FIG. 2, the system 40 works in much the same way as the open loop EFI system 10 except for the addition of the oxygen sensor 42. The oxygen sensor 42 senses the amount of oxygen in the exhaust gas after combustion which is an indicator of whether the AFR is running at too high or too low a value. Data regarding the oxygen levels is transmitted to the ECU 14 and this information, along with information that may be available from other sensors, is processed and the amount of atomized fuel 38 injected is adjusted so that the actual AFR matches the requested relative AFR.

During full throttle conditions, on initial start-up, and during a transient occurrence (such as a load suddenly applied to the engine) the ECU 14 ignores inputs from the oxygen sensor 42, thereby mimicking an open loop state, and the engine 26 can produce more power by running an air-fuel mixture with greater (richer) amounts of fuel. Inputs from the oxygen sensor 42 are also ignored when the engine 26 is first started until appropriate operating temperatures are reached, wherein the time from start-up to oxygen sensor 42 input reading can be delayed from a minute to a couple of minutes, resulting in non-optimal engine performance. Closed loop EFI systems are known in the automotive industry.

It is known, in the automotive industry, to use a bump or projection or lack of projection on the crankshaft and/or camshaft to determine the position of the piston and when to start ignition. However, it is not known to incorporate a sensor to measure power output and/or power loads.

Other methods are still needed for optimizing the AFR and obtaining acceptable performance for an open loop or closed loop EFI system in a genset engine operating under a power load. Current genset engines are equipped with a simple ignition system that does not monitor current or voltage information and does not allow the controller to change spark timing.

SUMMARY

An open loop EFI system with an electrical sensor, or alternately a closed loop EFI system with an electrical sensor, on a genset engine, is described. The electrical sensor works in conjunction with a crank position sensor in order to optimize the spark timing. The EFI system described can be particularly useful on a genset engine, but may be used in any type of internal combustion engine where appropriate. Since a genset engine's exhaust emissions and general performance are a function of spark timing as well as optimal air-to-fuel ratios (AFR), the integration of an electrical sensor and crank position sensor, to control spark timing on a genset engine, provides optimal engine performance and efficiency when the current draws fluctuate.

The electrical sensor and crank position sensor send data to the electronic control unit (ECU) and this data, as well as data that may be provided by other available sensors, is used to determine the optimal AFR and spark timing. The ECU uses the information regarding the crank position to control and change the spark timing to vary it in accordance with the speed and load of the engine. The ECU uses other data to actuate the fuel injector and send the correct amount of atomized fuel to mix with the air flow to be combusted, in accordance with the spark timing, and the engine is able to reach acceptable performance.

At different engine speeds and loads where load, for example, is the alternator output, different spark timings are needed to attain optimal performance. The problem is that current genset engines are equipped with a simple ignition system that does not allow the controller to change spark timing. One solution for a genset engine, as described herein, is to provide an electrical sensor and crank position sensor to allow the genset engine to change spark timing dependent on speed, load, and/or other parameters, thereby optimizing exhaust emissions and engine performance without a noticeable degradation in performance. Spark timing can be further evaluated using inputs from one or more other sensors that supply data, for example, on engine speed, current load, oil temperature, etc. From these additional inputs, the spark timing can be further adjusted.

In some embodiments, a crank position sensor is used to sense a reference marking on the rotor or flywheel, instead of the commonly used bump on a crankshaft and/or camshaft, to determine the position of the piston and the correct time to start ignition. As the rotor rotates about the crankshaft, the reference marker will pass a crank position sensor. The ECU is able to determine when the reference marker passes the crank position sensor by examining the crank position sensor output.

Genset engines generally are stand-alone engines that generate power to run electrical devices. Measuring current load or voltage information, in engine-related applications, is rare for engines other than gensets. And, since power generation is a function of a genset engine, using load, current draw and voltage information as factors in determining engine performance optimization is advantageous. For example, the ECU can use the current and voltage information to calculate the generator power (generator power=voltage×current). The power can then be used as an input to lookup tables such as the requested AFR table. In another example, the ECU can use the calculated power to compare it to a certain limiting value, and determine if the genset should shut down or limit itself when a certain power output is reached, thereby acting like a software fuse or breaker.

A genset engine may be a back-up power source in the event of a loss of electrical grid power. In one embodiment, genset engines are provided in recreational vehicles to subsidize grid electricity or as the primary power source when grid electricity is not being used or when grid electricity fails. In other embodiments, the genset engine may be provided as a secondary source of power for the home or business. In yet another embodiment, the genset engine may be the primary source of power where grid power is not readily available, such as remote locations or construction sites. It is to be realized that genset engines have many uses and are not limited to the uses in the above stated embodiments.

In one embodiment, a genset engine is described that integrates an open loop EFI system with an electrical sensor and crank position sensor. For example, the crank position sensor or similar device may be used when the ECU is to control the spark timing and to control when the fuel is to be injected. The electrical sensor may be used, for example, in conjunction with the ECU, crank position sensor, and other sensors to optimize the spark timing or amount of fuel that is injected. In another embodiment, a genset engine is described that integrates a closed loop EFI system with an electrical sensor and crank position sensor. The closed loop EFI system is similar to the open loop system, except that the closed loop EFI system uses an oxygen sensor that inputs data regarding the exhaust gases to the ECU while the genset engine is running. Data from the oxygen sensor may be temporarily ignored by the ECU at start-up or during a time when additional loads are placed on the engine. Therefore, a closed loop EFI system mimics the operation of an open loop EFI system until the oxygen sensor is sufficiently warm. It will be appreciated that data from one or more sensors providing values for oil temperature, coolant temperature, time, or any combination may be employed in the determination of when to use the oxygen sensor's information for closed loop operation.

DRAWINGS

Figure 5:
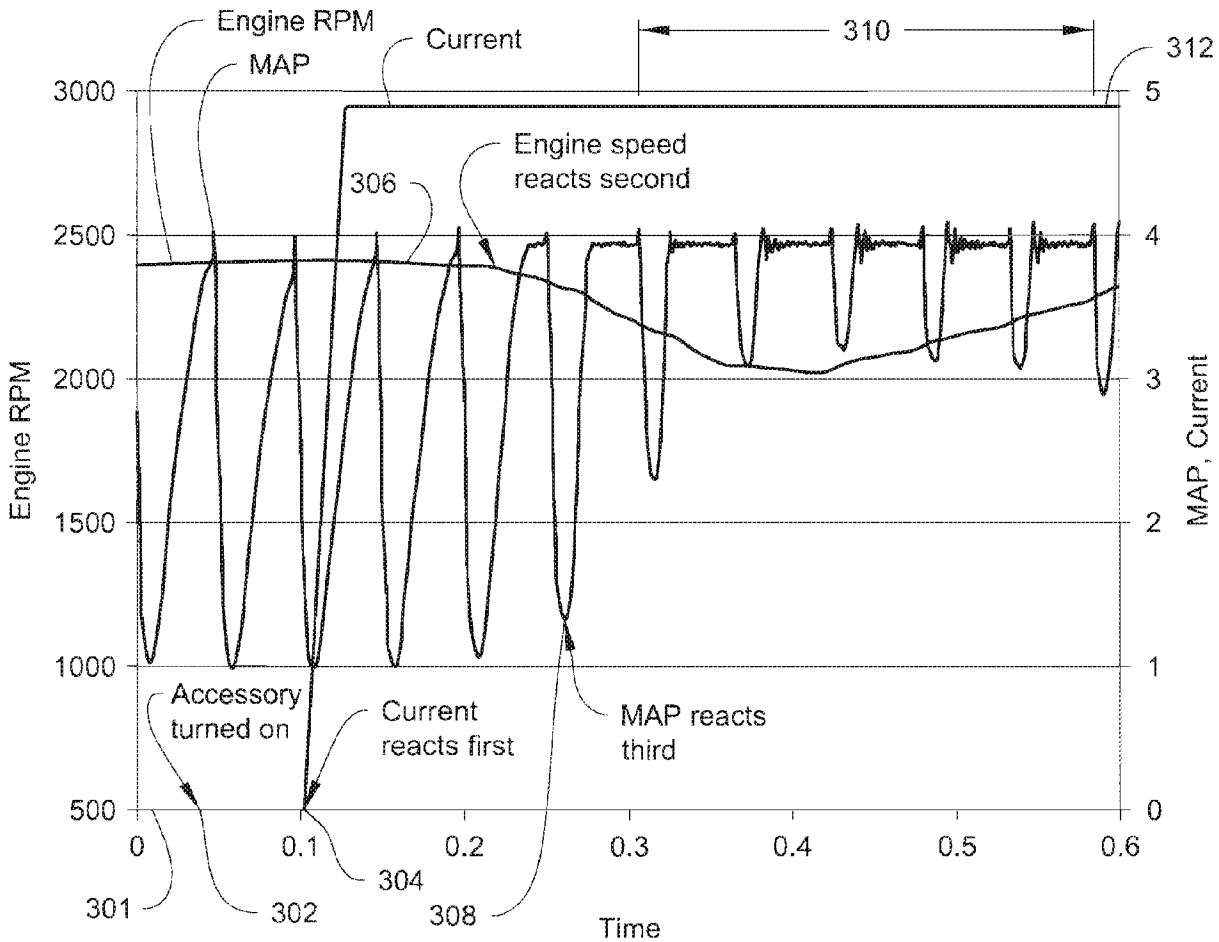

FIG. 5 graphically illustrates the reaction timing of an EFI system integrating an electrical sensor.

Figure 6:
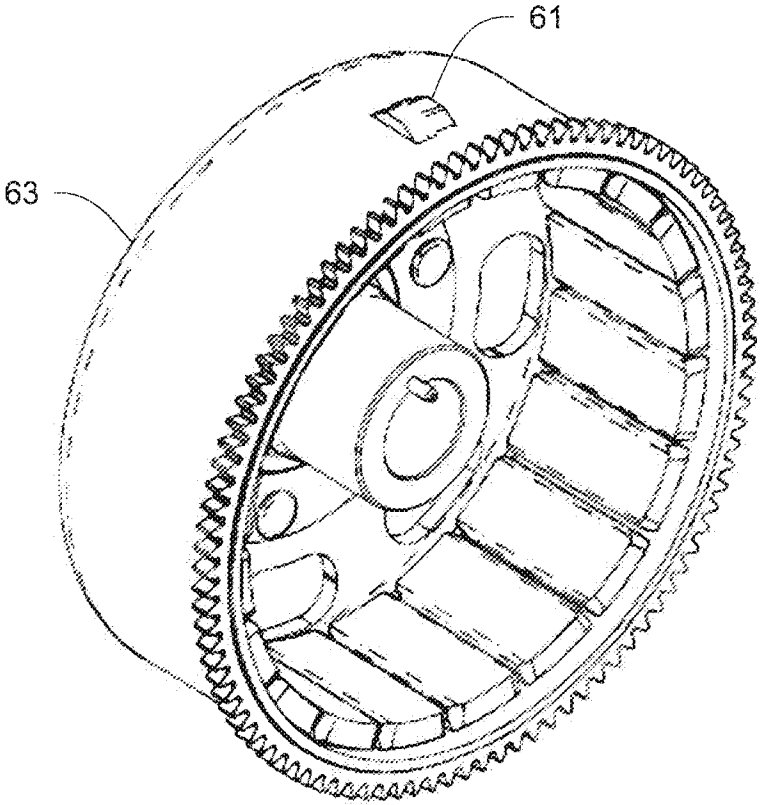

FIG. 6 illustrates one embodiment of a rotor incorporating a bump-type reference marker.

DETAILED DESCRIPTION

Figure 1:
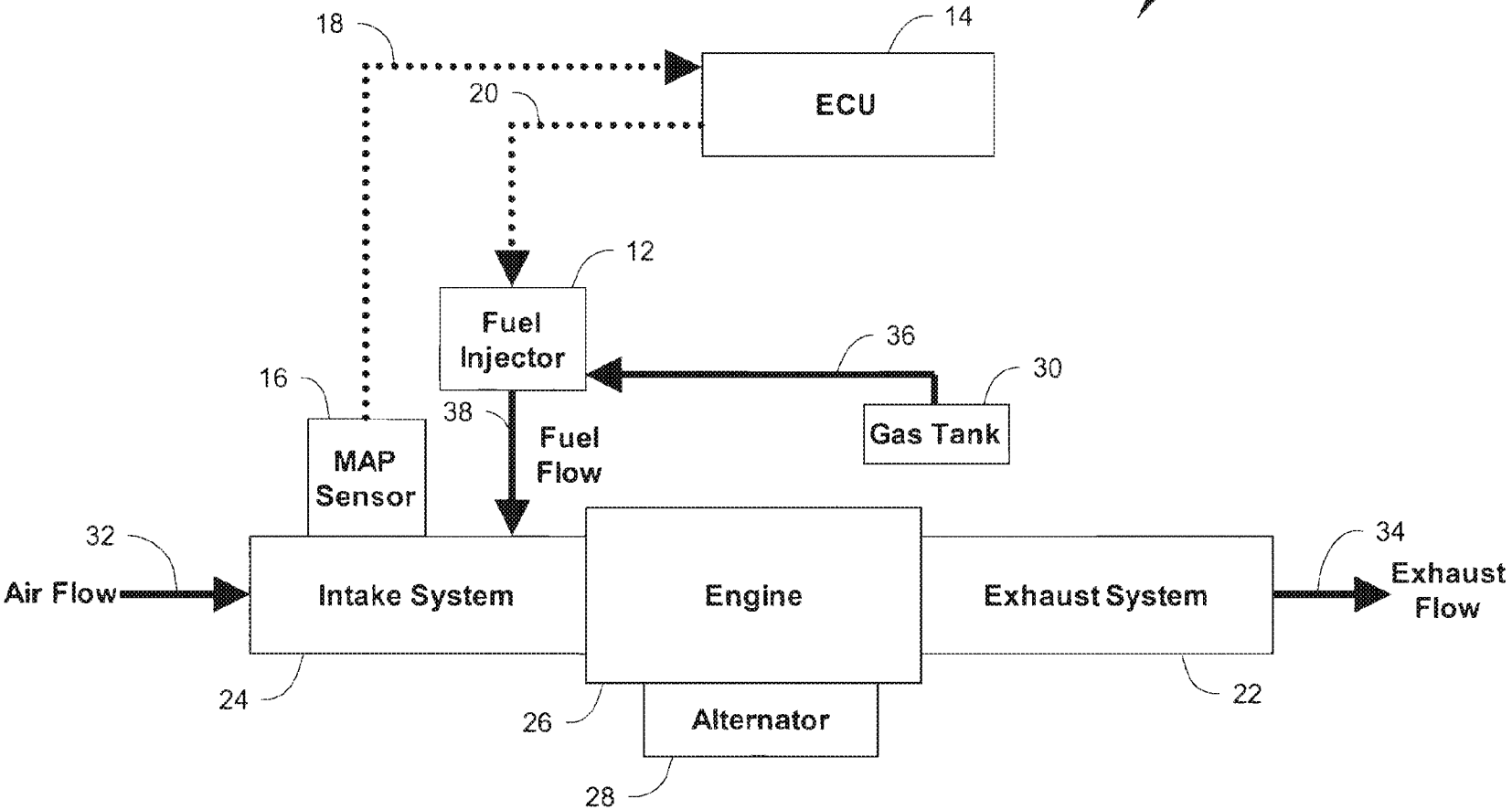
Fig. 1 (Prior Art)
FIG. 1 illustrates a conventional open loop EFI system.
Figure 2:
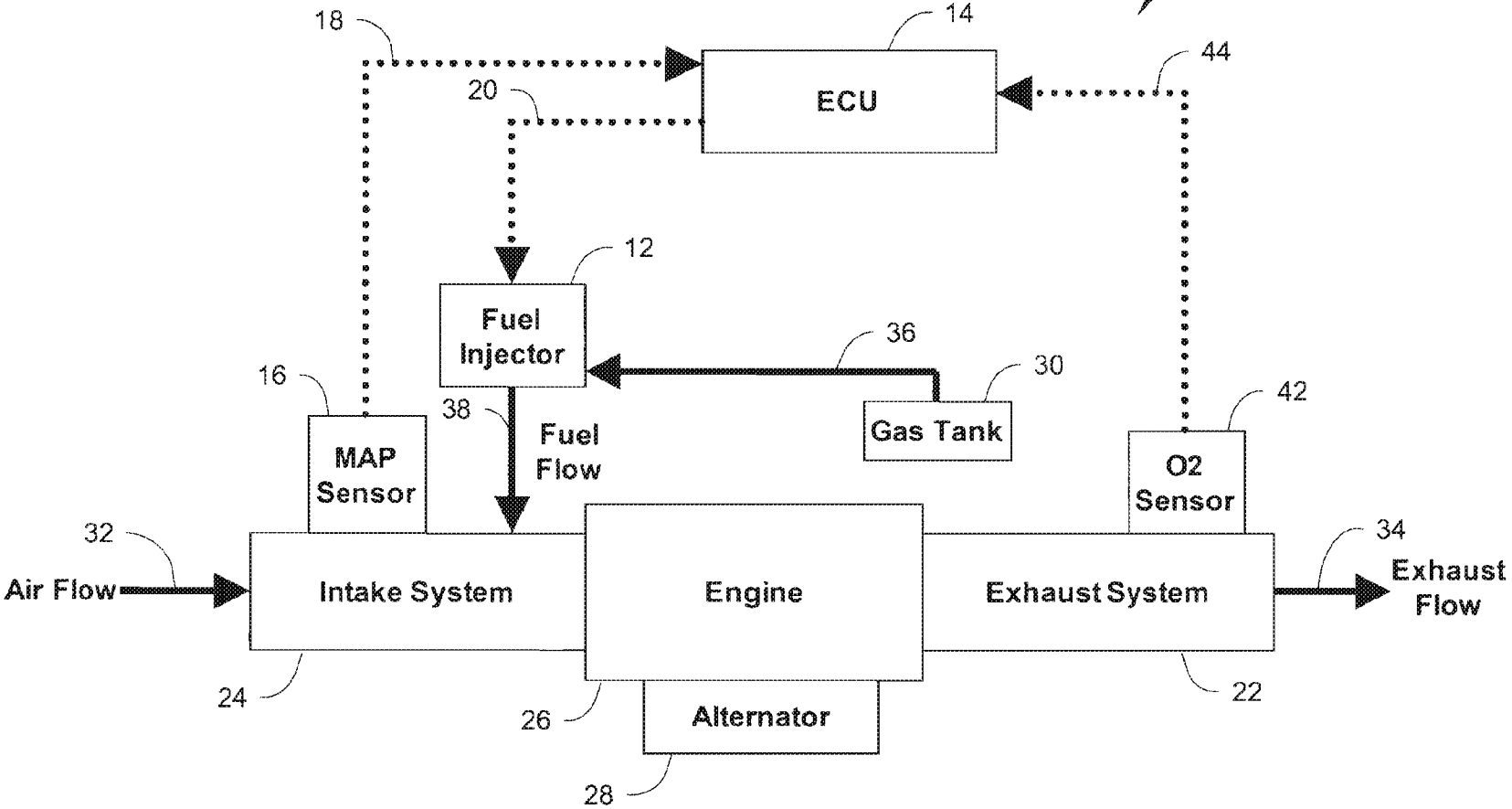
Fig. 2 (Prior Art)
FIG. 2 illustrates a conventional closed loop EFI system.
Figure 3:
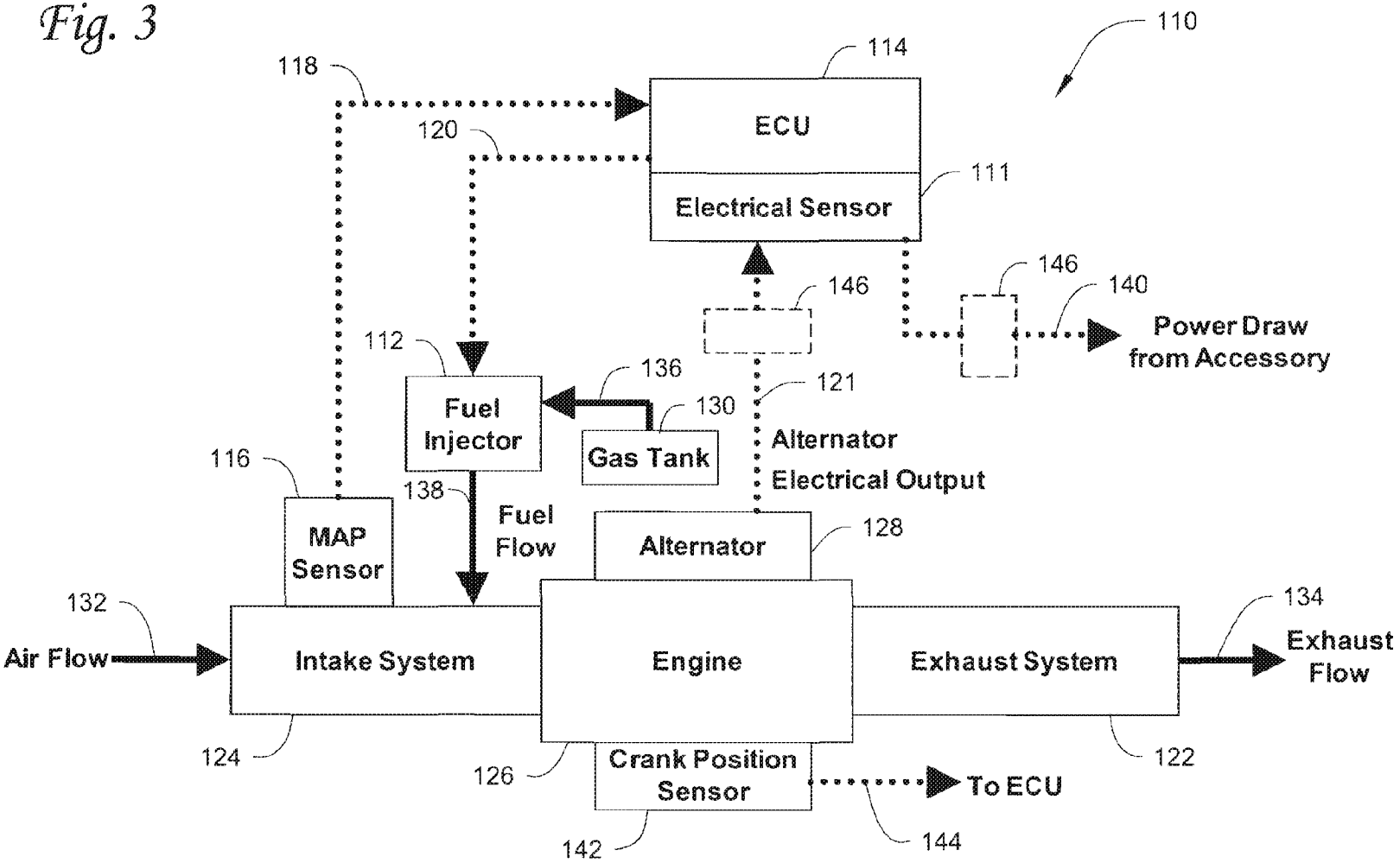
FIG. 3 illustrates a schematic of an open loop EFI system integrating an electrical sensor.
Figure 4:
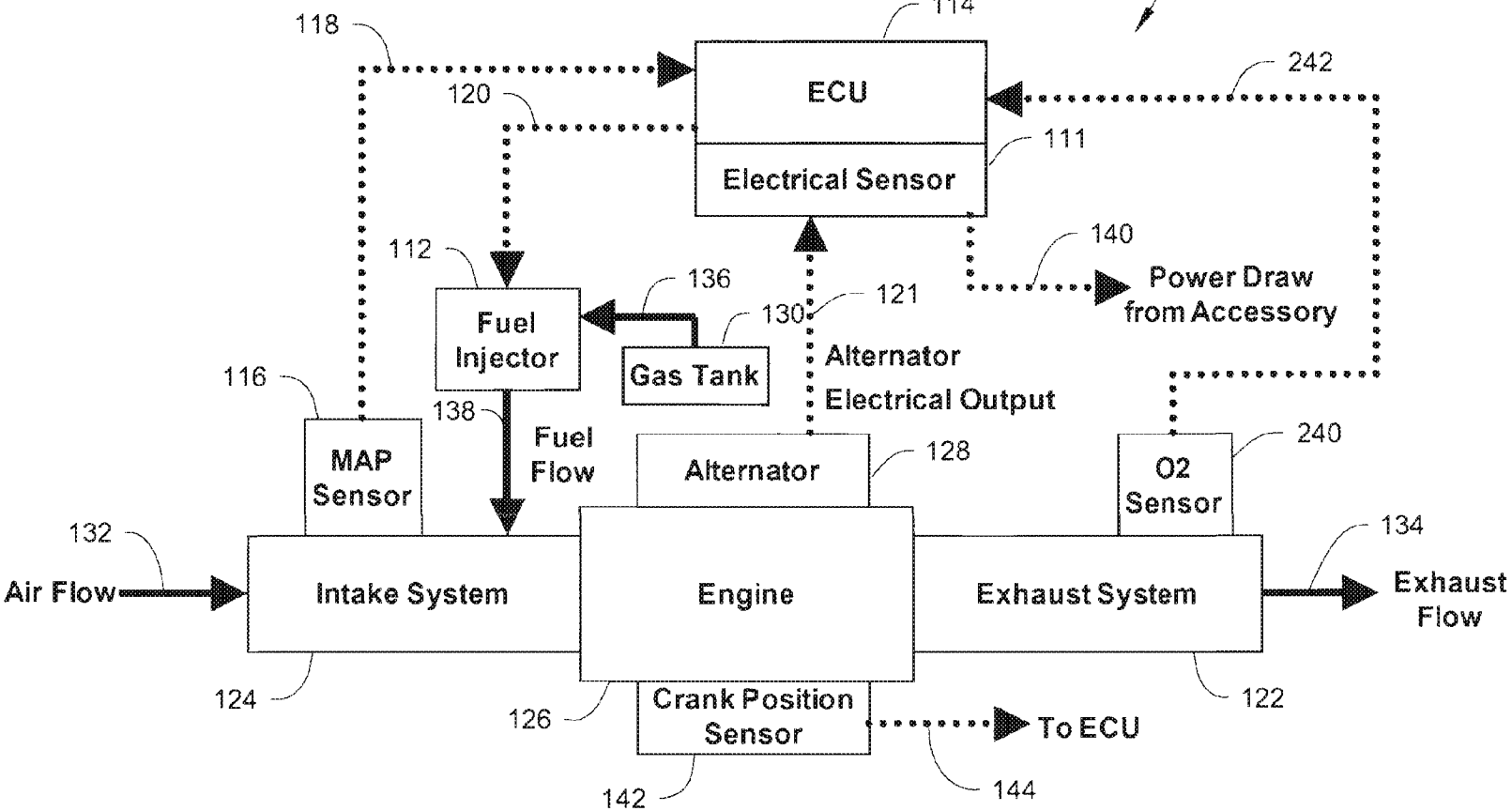
FIG. 4 illustrates a schematic of a closed loop EFI system integrating an electrical sensor.

FIGS. 3-5 illustrate embodiments of an EFI system in accordance with inventive principles described herein. For example, an open loop EFI system with an electrical sensor and crank position sensor, or alternately a closed loop EFI system with an electrical sensor and crank position sensor, is described. The EFI system can be used on a genset engine or any type of internal combustion engine. A genset engine's exhaust emissions and general performance are a function of spark timing. Spark timing determines when the air-fuel mixture will be ignited. The ignition of the air-fuel mixture must be at precisely the right moment, the moment when the piston is at its optimal position, or emissions can increase and engine performance is compromised. The integration of an electrical sensor and crank position sensor on a genset engine provides optimal engine performance and efficiency when the power needs fluctuate due to increased or decreased load on the genset engine, for example at start up or at other times during engine operation. The electrical sensor sends data to the electronic control unit (ECU) and this data, as well as data that may be available from other sensors, is used to determine the requested relative air-to-fuel ratio (AFR) and the optimal spark timing. Other data can include MAP, MAT, oil temperature, coolant temperature and engine speed.

The crank position sensor determines the location of the reference marker and sends this date to the ECU which then determines the spark timing. The ECU then instructs the ignition system telling it when to spark. It will be appreciated that the spark timing can be varied in accordance with the speed and load of the engine and such inputs (e.g. electrical sensor) may be used by the ECU in the spark timing determination.

For example, the ECU actuates the fuel injector, based on data input from the electrical sensor, the crank position sensor and other sensors, and the fuel injector sends the correct amount of atomized fuel to mix with the air flow to be combusted. This provides the genset engine with a fuel mixture that is at the requested relative AFR in accordance with the optimal determined spark timing and the genset engine is able to operate efficiently and with acceptable performance.

As described herein, measurement of power, using current, voltage, or both, is unique to a genset engine. Genset engines have an electrical power output and the current and voltage are relatively easy to measure, whereas automotive systems and most others have power output that is mechanical shaft power, where the load current and voltage are not measured and are difficult to measure. Normally, when the load increases on a genset engine, the genset engine loses power and the engine then works to catch-up, thereby affecting performance before the AFR can be adjusted with known sensors. An improvement upon existing genset engines as described herein is to use an electrical sensor that can nearly instantaneously sense, for example, the change in load and can effect a change in the ignition system before the performance of the genset engine is affected, usually in less than a second. Nearly instantaneously can also be meant as on the order of an engine cycle, which is approximately 17 milliseconds for an engine operating at 3600 rpm. Therefore, one solution herein is to measure the current load and/or voltage using an electrical sensor and obtaining the crank position using the crank position sensor, so as to adjust the spark timing of the ignition system prior to degradation of performance. And, even though other sensors may be present, it may be enough that the electrical sensor and crank position sensor alone may be sufficient provide data to the ECU to ensure that performance is not degraded. It is to be realized that changes in the genset engine performance can occur when loads decrease and even though the description herein generally relates to a load increase, the functionality of the system when loads decrease is much the same.

With reference to FIG. 3, an embodiment of an open loop EFI system 110 integrated with a genset engine is shown. As shown in this embodiment, for example, the open loop EFI system 110 includes a fuel injector 112, an electronic control unit (ECU) 114, an air flow sensor such as a manifold absolute pressure (MAP) sensor 116, an electrical sensor 111, a crank position sensor 142, communication circuitry 118 linking the ECU 114 and the MAP sensor 116, communication circuitry 120 linking the ECU 114 and the fuel injector 112, communication circuitry 144 linking the ECU 114 and the crank position sensor 142, and communication circuitry 121 linking the electrical sensor 111 and the alternator 128. One or more other types of air flow sensors can be used, for example, a MAT and/or MAP sensor to determine air flow and/or a hot-wire anemometer or some type of strain gauge.

Other known components sometimes used in such genset engine systems, but not shown in FIG. 3, include a fuel pump, a fuel pressure regulator, other various input sensors, which may include, a hall effect sensor, a throttle position sensor, a coolant temperature sensor, an oil temperature sensor, and a manifold air temperature (MAT) sensor. With further reference to FIG. 3, features of the genset engine system include an intake system 124, the engine 126, an alternator 128, an exhaust system 122, and a gas tank 130. Air flow 132 enters at the intake system 124 and exhaust flow 134 exits at the exhaust system 122. Fuel 136 moves from the gas tank 130 to the fuel injector 112 and is atomized. The atomized fuel 138 enters the intake system 124.

The ECU 114 is the system computer and monitors engine operating parameters via various sensors and transmits signals to various components instructing the components to adjust their operation. The ECU 114 contains look-up tables or algorithms used to determine the requested relative air-to-fuel ratio (AFR) for acceptable engine performance. The stoichiometric AFR is a function of fuel composition and is the mass ratio of air to fuel in which there is not excess air or excess fuel after combustion. The ECU 114 uses the data from the sensors to determine the requested relative AFR ratio which is the ratio of the actual AFR to the stoichiometric AFR. The ECU 114 determines the requested relative AFR and sends a signal to the fuel injector 112 to open it at a specific time and for a specific length of time.

To have the genset engine 126 start and operate at the requested relative AFR ratio in the calibration, the ECU 114 determines the amount of fuel that is needed and actuates the fuel injector 112 such that fuel mixes with the air flow to reach the requested relative AFR. One way to accomplish this, for example, the ECU 114 also receives information from the electrical sensor 111 based on the electrical output 121 provided from the alternator 128 versus the power draw 140. The ECU 114 also has a spark timing map which may be a table with engine speed on one axis and engine load on another axis. The ECU 114 uses the data from the crank position sensor to determine the correct spark timing for the engine's ignition system based on the values in the spark timing map. The ECU then sends a signal to the engine's ignition system in order to effectuate the spark timing at a crank position specified by a table in the ECU 114. For example, the ECU 114 may have a table that calls out when the spark timing should be and uses the information from the crank position sensor so that it knows when to start the spark timing. Using the information from the crank position sensor, the ECU 114 can instruct the ignition to spark.

The fuel injector 112 is an electro-mechanical valve that provides metering of the fuel into the genset engine 126. The fuel injector 112 is normally closed, and opens to inject pressurized fuel for a specified length of time. The fuel injector 112 atomizes the fuel by forcibly pumping the fuel through a small nozzle under high pressure and, in one embodiment, the atomized fuel 138 is mixed with the air flow 132 in the intake system 124 of the genset engine 126. In another embodiment, the atomized fuel 138 and air flow 132 are mixed in the combustion area of the genset engine 126. The ECU 114 sends signals to the fuel injector 112 via communication circuitry 120.

In one embodiment, the electrical sensor 111 senses the electrical output 121 that is output from the alternator 128 and the power draw 140 that is needed by various appliances or accessories. It is to be noted that the electrical sensor 111 can sense either voltage or current, or both. In one embodiment, the electrical sensor 111 can be disposed on or within the ECU 114. For example, a printed circuit board resides within the ECU 114 and the electrical sensor 111 may be mounted to the printed circuit board. Information from the printed circuit board is then transmitted directly to the ECU 111. In another embodiment, the electrical sensor 111 can be mounted externally to the ECU 114, for example, incorporated as part of the wiring harness or communication circuitry 121. In yet another embodiment, electrical sensor 111 can be disposed on or within the alternator 128.

In one embodiment, the alternator electrical output (e.g. sensed by electrical sensor via communication circuitry 121) may be further conditioned before being delivered to accessories powered by the genset engine. For example, the alternator electrical output goes to conditioning hardware (see dashed box 146), which can be a rectifier or inverter. The conditioning hardware may be disposed at any location between the alternator 128 and the accessories. Conditioning hardware is well known and not further described. Once alternator electrical output is conditioned, it may then go to a load (e.g. accessory via power draw 140) that is put on the genset engine 126.

In one embodiment, the electrical sensor 111 can be disposed between the alternator 128 and conditioning hardware 146 and/or after the conditioning hardware 146.

In another embodiment, the power out of the conditioning hardware can be divided between the power that is transmitted to the accessories and the power that is transmitted back to the genset engine 126 for powering its components, e.g., the fuel pump.

In yet another embodiment, the power from the alternator 128 goes directly to the accessories and measurements are taken directly out of the alternator 128 (e.g. without using conditioning hardware 146). For example, the alternator may include windings such that they may be split so that one set of windings is for the accessories and the other set(s) is used for different purposes such as powering an ignition coil or providing power for charging a battery. In this case, there may be no separate conditioning hardware. It will be appreciated however that conditioning hardware may be used, for example, where a single piece of conditioning hardware is employed for one set of the windings, or where conditioning hardware is provided for each set of windings. The power could be measured after each set of windings and after the conditioning hardware if the genset 126 uses such hardware. It will be appreciated that alternator windings are well known and not further described.

With reference to the electrical sensor and the information it reads (e.g. current and/or voltage information from an alternator), the ECU 114 in one embodiment can use the current and/or voltage information to calculate the generator power (e.g. generator power=voltage×current). The power can then be used as an input to one or more lookup tables in the ECU, such as for example the requested AFR table.

In some embodiments, the power calculated could be used to compare it to a certain limiting value and then determine whether the genset engine 126 should shut down or limit itself, such as for example when a certain power output is reached. In such a configuration, the EFI system can act like a software fuse or breaker.

In yet another embodiments, if the alternator 128 efficiency is known, the engine power can also be calculated (engine power=genset power/alternator efficiency) and the engine power can be used in the calibration, e.g., as an input to the requested AFR lookup table.

With reference to the crank position sensor 142, the sensor 142 is configured to determine the location of a reference marker 61 located, for example, on rotor 63. In one embodiment, the reference marker 61 is, for example, a bump as illustrated in FIG. 6. It will be appreciated that other suitable indicators may be used as a reference marker 61, such as for example, an indentation (not shown) on the rotor 63. In the example shown, the reference marker 61 provides the position of the position of the piston when sensed by the crank position sensor 142, and this data which may contain information regarding the crank angle is transmitted to the ECU 114. The ECU 114 then starts the ignition process and adjusts the spark timing by using information from the crank position sensor, other sensors that may be available, and lookup tables. This information is transmitted to the ECU 114 via communication circuitry 144.

As shown in the embodiment of FIG. 3, when a MAP sensor is employed as the air flow sensor, the MAP sensor 116 measures the amount of vacuum in the intake manifold of the genset engine 126. The pressure measurement is sent as data to the ECU 114 via communication circuitry 118. The MAP sensor 116 is disposed on the intake system or the intake manifold 124 of the genset engine 126.

With further reference to the embodiment of FIG. 3, as the genset engine 126 is running, the MAP sensor 116 senses the vacuum in the intake manifold 124 and transmits this data to the ECU 114 and, at the same time for example, the electrical sensor 111 senses the alternator electrical output and the power draw 140 and transmits this data to the ECU 114. The crank position sensor 142 also transmits the location of the reference marker 61 to the ECU 114. One or more other sensors that may be available may also send information to the ECU 114. The ECU also can use the power draw 140 data and data supplied from the MAP sensor 116, as well as any data that may be available from other sensors, to determine the correct spark timing and the requested relative AFR ratio, which is the ratio of the actual AFR to the stoichiometric AFR. It will be appreciated that the requested relative AFR is a value set in a look-up table of the ECU that will provide acceptable genset engine 126 performance based on the given parameters. While the requested relative AFR is generally not a direct function of crank position, the requested relative AFR is a parameter characteristic of the entire engine cycle, which can be a function of current draw, and where use of data provided by the electrical sensor is appropriate.

The ECU 114 electrically actuates the fuel injector 112 so that the atomized fuel 138 mixes with the air flow 132 to reach the requested relative AFR. In one embodiment, to have the genset engine 126 operate at the requested relative AFR ratio in the calibration, the ECU 114 may use for example, the air pressure information (e.g. air flow sensor such as for example MAP 116), the electrical output information (e.g. sensed by the electrical sensor), the power draw 140 information to obtain the requested relative AFR ratio, so as to determine the amount of fuel 136 that is needed.

The ECU 114 can then actuate the fuel injector 112 such that atomized fuel 138 mixes with the air flow 132 to reach the requested relative AFR. Under such a configuration for example, the ECU 114 can know how much fuel is needed for each fueling cycle. A fueling cycle is, for example, two engine cycles in a four-stroke engine. With information from the sensors, the ECU 114 can obtain the airflow information for each fueling cycle. With the air flow information, the ECU can determine the requested relative AFR to calculate the fuel flow. In one embodiment, the ECU 114 determines the requested AFR from a lookup table, with one of the inputs to the lookup table being the information from the electrical sensor 111.

It will be appreciated that the crank position sensor 142 is not an input to the AFR table. Once the air flow and the requested AFR are determined, the fuel flow can be calculated. The ECU 114 uses information from the crank position sensor 142 to determine and adjust the spark timing, and to determine when to turn the fuel injector on and off.

During the operation of the genset engine 126, the sensors 111, 116, 142 continuously monitor and send data to the ECU 114 so that real-time adjustments are made to the spark timing and the requested relative AFR and the genset engine 126 runs at acceptable performance. When the power draw 140 increases or decreases, the ECU 114 nearly instantaneously sends a signal to adjust the spark timing, resulting in a minimal performance degradation even with an increased/decreased load. The ECU 114 also sends a signal to the fuel injector to increase or decrease the amount of fuel injected based on the requested relative AFR, thereby insuring that the correct amount of fuel is available for the next cycle. Due to the integration of the electrical sensor 111 and the crank position sensor 142, the genset engine 126 can have additional power draw 140 placed on it and the open loop EFI system 110 will adjust, for example in less than a second, without a notable loss of performance. The ignition system uses input from a reference marker 61, where in some embodiments for example the reference marker is disposed on the rotor 63 or flywheel. The reference marker 61 is sensed by the crank position sensor to provide the position for example of the piston and when to start ignition.

In one embodiment, as shown in FIG. 6, the reference marker 61 is for example a bump on the rotor 63. Other benefits of integrating an electrical sensor 111 and a crank position sensor 142 with an open loop EFI system 110 on a genset engine 126 can include, the ability to control genset overspeed, improved starting capabilities, improved service diagnostics, retardation of the timing to decrease nitrous oxide emissions, retardation of the timing when the oil temperature is too hot so that the engine is not damaged from knock, and optimization of the timing to reach maximum brake power.

FIG. 4 shows an embodiment of a closed loop EFI system 210 integrated with a genset engine. The closed loop EFI system 210 includes, for example an oxygen sensor 240, a fuel injector 112, an electronic control unit (ECU) 114, an air flow sensor (e.g. MAP sensor 116), an electrical sensor 111, a crank position sensor 142, communication circuitry 242 linking the ECU 114 and the oxygen sensor 240, communication circuitry 118 linking the ECU 114 and the MAP sensor 116, communication circuitry 120 linking the ECU 114 and the fuel injector 112, communication circuitry 144 linking the ECU 114 and the crank position sensor 142, and communication circuitry 121 linking the electrical sensor 111 and the alternator 128.

Other known components sometimes used in such genset engine systems, but not shown in FIG. 4, include a fuel pump, a fuel pressure regulator, other various input sensors, which may include, a hall effect sensor, a throttle position sensor, a coolant temperature sensor, an oil temperature sensor, and a manifold air temperature (MAT) sensor. As shown in FIG. 4, the genset engine system also includes an intake system 124, the engine 126, an alternator 128, an exhaust system 122, and a gas tank 130. Air flow 132 enters at the intake system 124 and exhaust flow 134 exits at the exhaust system 122. Fuel 136 moves from the gas tank 130 to the fuel injector 112 and is atomized. The atomized fuel 138 enters the intake system 124.

The oxygen sensor 240 determines the AFR of the genset engine 126 by reading the oxygen concentration of the exhaust flow 134 in the exhaust system 122. The oxygen sensor 240 reads the oxygen content of the exhaust gases after combustion and transmits this data to the ECU 114 via communication circuitry 242. The ECU 114 then determines if the AFR is too rich or too lean for optimum combustion and adjusts the fueling accordingly. On starting, during load transients, and under full throttle conditions, i.e. when there is a load on the genset engine 126, the inputs from the oxygen sensor 240 to the ECU 114 may be ignored by the ECU 114, resulting in the closed loop system mimicking an open loop system, so that the engine 126 can produce more power by running a richer mixture. Generally, it will be appreciated that the electronic control unit is configured to temporarily ignore the data from the oxygen sensor when a change in magnitude of the power draw occurs, such as the events described above.

At a cold start-up, the oxygen sensor 240 inputs may be ignored for up to three minutes or longer until the oxygen sensor 240 reaches the operating temperature needed to provide an accurate reading. Therefore, when the load is increased, the ECU 114 may ignore the oxygen sensor 240 inputs and the closed loop system 210 integrated with an electrical sensor 111 and crank position sensor 142 mimics the open loop system 110 as described in the embodiment of FIG. 3. The genset engine 126 may ignore the oxygen sensor 240 until the engine 126 reaches a steady state. At this time, the ECU 114 will begin reading and using the data supplied by the oxygen sensor 240.

The genset engine 126 described herein is capable of operating within performance and emission requirements due to its ability to sense the electrical output 121 from the alternator 128 and the power draw 140 needed, transmitting this data to the ECU 114 which subsequently controls the spark timing and fueling to attain the correct AFR needed for acceptable performance. With respect to the actual value of the AFR needed to run the genset engine, the AFR is a function of the fuel and therefore may differ according to the fuel blend used. For example, an engine running on gasoline may require an AFR slightly rich of stoichiometric (about 14.6), while an engine running on 100% ethanol may also require an AFR slightly rich of stoichiometric but somewhat lower AFR (about 9.0). Since these stoichiometric are considerably different, the term relative AFR is used to compare actual engine AFR's on an equal basis. Relative AFR is the ratio of the actual AFR to the stoichiometric AFR. Therefore, one advantage of the genset engine 126 as described herein is that the genset engine 126, open loop or closed loop, will be able to maintain the needed electrical requirements while optimizing emissions and performance. The transient response of the genset engine 126 will be improved. The transient step load response will be quicker and the step up in power will be almost instantaneous without the delay currently associated with genset engines 126.

FIG. 5 shows an example operation of a genset engine 126 (e.g. of FIGS. 3 and 4). FIG. 5 shows that the genset can be running in a steady state 301. When an accessory is turned on 302, the power draw 140 on the engine is increased 304. The engine 126 speed begins to react but the electrical sensor 111 has already identified the power draw 140 increase and has transmitted this data to the ECU 114 to adjust the spark timing 306. This illustrates how the ECU 114 can react and change the fueling or spark timing even faster than the engine speed or MAP 116 changes. In the example shown in FIG. 5, the spark timing maybe adjusted at the 0.16 second mark. The MAP 116 identifies a change 308 in the air pressure and transmits this data to the ECU 114. The ECU 114 uses the air pressure data, the electrical output 121 data, and power draw 140 data to continue to fine tune 310 the fueling based on the load first, and then continually fine tune 310 with the information from the MAP 116 or crank position sensor 142. In this manner, the genset engine 126 can maintain its steady state operation with no loss 312 of power draw 140 and engine emissions and performance are optimized. This process is preferably completed in less than a second and appears seamless to the user.

The examples and embodiments disclosed in this application are to be considered in all respects as illustrative and not limitative. The scope of the invention is indicated by the appended claims rather than by the foregoing description; and all changes which come within the meaning and range of equivalency of the claims are intended to be embraced therein.

The invention claimed is:

1. A genset engine integrating an electronic fuel injection system comprising:

an electrical sensor;

a crank position sensor;

a fuel injector;

an electronic control unit;

an air flow sensor;

a first communication circuitry linking the electronic control unit and the electrical sensor;

a second communication circuitry linking the electronic control unit and the crank position sensor;

a third communication circuitry linking the electronic control unit and the fuel injector; and a fourth communication circuitry linking the electronic control unit and the air flow sensor, wherein the electrical sensor is configured to read an electrical output from an alternator, the electrical sensor is configured to read a power draw on the genset engine, the crank position sensor is configured to read a position of a piston, the electronic control unit is configured to (1) receive data from the electrical sensor, crank position sensor, and air flow sensor via the first, second, and fourth communication circuitry, respectively, (2) determine a spark timing based on the crank position sensor which is transmitted to an ignition system to change a spark timing of the engine, (3) determine a requested relative air to fuel ratio based on the data received from the electrical sensor and the air flow sensor, and (4) actuate the fuel injector via the third communication circuitry based on the determined requested relative air to fuel ratio and the spark timing.

2. The genset engine integrating an electronic fuel injection system of claim 1, wherein the electrical sensor is disposed in or on the electronic control unit.

3. The genset engine integrating an electronic fuel injection system of claim 1, wherein the fuel and air are mixed in an intake system of the engine, or the fuel and air are mixed in a combustion area of the engine.

4. The genset engine integrating an electronic fuel injection system of claim 1, further comprising a reference marker disposed on a rotor of the genset engine, the reference marker configured to be located by the crank position sensor to determine the position of a piston.

5. The genset engine integrating an electronic fuel injection system of claim 1, wherein the genset engine is provided in a recreational vehicle.

6. The genset engine integrating an electronic fuel injection system of claim 1, wherein the genset engine is a stand-alone engine.

7. The genset engine integrating an electronic fuel injection system of claim 1, further comprising an oxygen sensor, a fourth communication circuitry linking the electronic control unit and the oxygen sensor, and wherein the electronic control unit is configured to receive data from the oxygen sensor via the fourth communication circuitry.

8. The genset engine integrating an electronic fuel injection system of claim 7, wherein the electronic control unit is configured to temporarily ignore the data from the oxygen sensor when a change in magnitude occurs in the power draw.

9. The genset engine integrating an electronic fuel injection system of claim 7, wherein the electronic control unit is configured to temporarily ignore the data from the oxygen sensor when full throttle conditions exist.

10. A method of controlling air to fuel ratio in a genset engine comprising:

integrating a genset engine with an electronic fuel injection system, the electronic fuel injection system including an electrical sensor, a crank position sensor, a fuel injector, an electronic control unit, an air flow sensor, a first communication circuitry linking the electronic control unit and the electrical sensor, a second communication circuitry linking the electronic control unit and the crank position sensor, a third communication circuitry linking the electronic control unit and the fuel injector, and a fourth communication circuitry linking the electronic control unit and the air flow sensor, where the electrical sensor reads an electrical output from an alternator of the genset engine, the electrical sensor reads a power draw on the genset engine, and the crank position sensor reads a position of a piston;

transmitting data from the electrical sensor, crank position sensor, and air flow sensor to the electronic control unit via the first, second, and fourth communication circuitry, respectively, transmitting data from the electronic control unit based on data from the crank position sensor to an ignition system to change a spark timing, obtaining a requested relative air to fuel ratio based on data from the electrical sensor and the air flow sensor, and activating the fuel injector via the third communication circuitry and based on the requested relative air to fuel ratio and the spark timing.

11. The method of claim 10, further comprising determining a position of a piston by placing a reference marker on a rotor of the ignition system and sensing the position with the crank position sensor.

12. The method of claim 10, further comprising linking the electronic control unit and an oxygen sensor through a fourth communication circuitry, and transmitting data read by the oxygen sensor to the electronic control unit via the fourth communication circuitry.

13. The method of claim 12, further comprising temporarily ignoring the data from the oxygen sensor when a change in magnitude occurs in the power draw.

14. The method of claim 12, further comprising temporarily ignoring the data from the oxygen sensor when full throttle conditions exist.

* * * * *